US005277408A

United States Patent [19]

Parker

[11] Patent Number: 5,277,408

[45] Date of Patent: Jan. 11, 1994

[54] FENCE EMPLOYING FLAT SIDED GALVANIZED STEEL POSTS AND CHANNEL PARTS

[76] Inventor: Alton B. Parker, 3822 Olympia Dr., Houston, Tex. 77019

[21] Appl. No.: 760,936

[22] Filed: Sep. 17, 1991

Related U.S. Application Data

[63] Continuation-in-part of Ser. No. 559,623, Jul. 30, 1990, abandoned.

[51] Int. Cl.[5] ..... E04H 17/16

[52] U.S. Cl. ..... 256/65; 256/67; 256/60; 256/59; 256/27; 403/231; 403/87

[58] Field of Search ..... 256/24-27; 65-67, 59, 60, 73, 21, 22, 19, DIG. 5; 403/205, 231, 403, 84, 85, 61, 87, 31, 68; 72/399; 52/239, 243

[56] References Cited

U.S. PATENT DOCUMENTS

| | | | |
|---|---|---|---|
| 2,642,269 | 6/1953 | Daniel | 256/24 X |
| 2,795,063 | 6/1957 | Butler | 256/24 X |
| 2,809,017 | 10/1957 | Wong | 256/24 X |
| 3,101,929 | 8/1963 | Dvore | 256/24 |
| 3,285,576 | 11/1966 | Clark | 256/21 |
| 3,383,819 | 5/1968 | Zimmer et al. | 256/24 X |
| 3,955,800 | 5/1976 | Russo | 256/59 |
| 4,003,553 | 1/1977 | Morris | 256/59 |
| 4,032,248 | 6/1977 | Parduhn et al. | 256/DIG. 2 X |
| 4,063,714 | 12/1977 | Kirkwood | 256/24 |
| 4,078,772 | 3/1978 | Carbone | 256/24 |
| 4,140,298 | 2/1979 | Coleman, Jr. | 256/65 |
| 4,188,019 | 2/1980 | Meredith | 256/24 |
| 4,306,631 | 12/1981 | Reusser | 256/24 X |
| 4,369,953 | 1/1983 | Greiner et al. | 256/24 |
| 4,471,947 | 9/1984 | Osborne | 256/24 |
| 4,508,320 | 4/1985 | Hegarty | 256/47 |
| 4,899,991 | 2/1990 | Brunkan | 256/24 X |
| 4,901,650 | 2/1990 | Armstead | 211/186 X |

FOREIGN PATENT DOCUMENTS

| | | | |
|---|---|---|---|
| 2129845 | 5/1984 | United Kingdom | 256/24 |

*Primary Examiner*—Randolph A. Reese
*Assistant Examiner*—Harry C. Kim
*Attorney, Agent, or Firm*—Vaden, Eickenroht, Thompson, Boulware, & Feather

[57] ABSTRACT

A fence frame is disclosed that preferably comprises galvanized steel posts that provide an accessible flat surface or surfaces parallel with the surface of the transverse railings and through which are applied holding bolts for securing the post to adjoining ends of railing sections. The posts include at least one strengthening vertical bend. One post structure employs a tubular post support joined to the fence railing sections using a tubing-clamp-and-rail-hanger combination that allows the tubing surface to be firmly held by a piece that integrally has suitable flat-sided structures for attaching to the adjacent railing sections. Corner posts employing the same basic structure as the in-line posts or specifically designed posts are provided. The fence frame comprised of posts and railings are suitable for receiving a fence covering made up of aluminum sheet panels, plastic panels, wood pickets, plastic pickets, metal rods or other coverings of choice.

2 Claims, 3 Drawing Sheets

FIG. 1
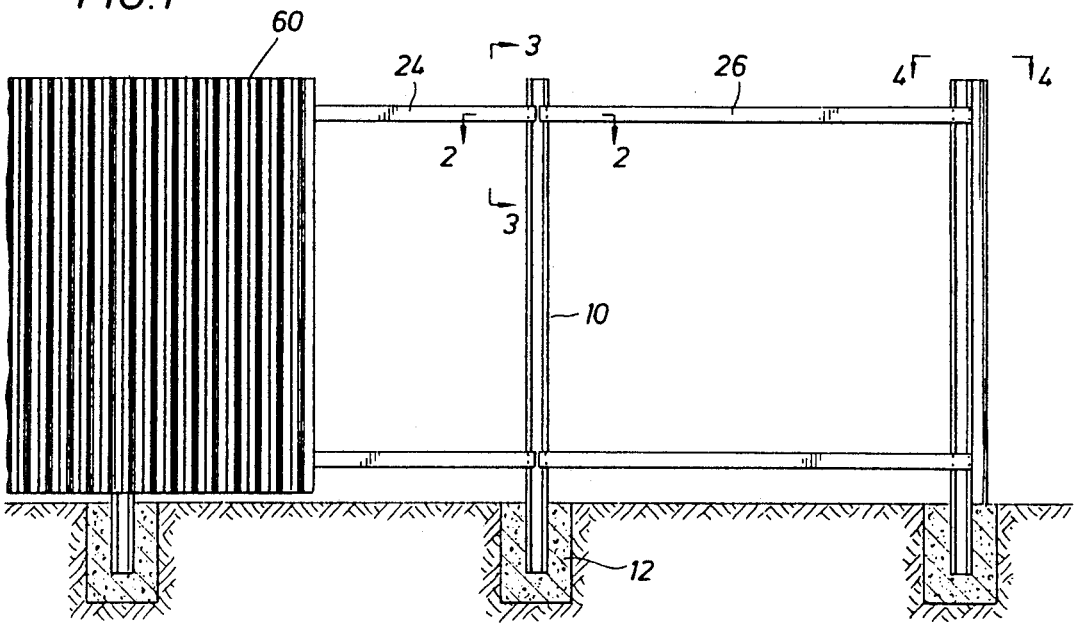
FIG. 2
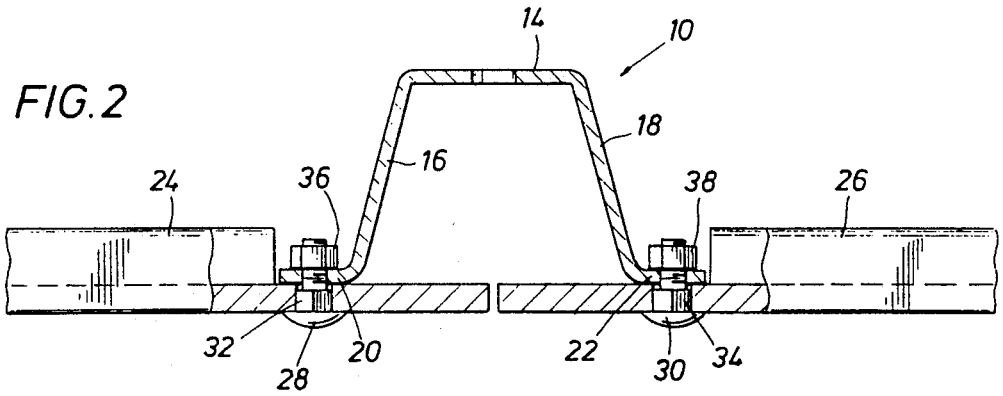
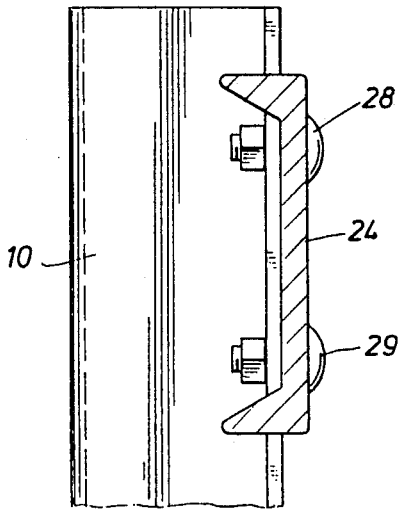
FIG. 3

FIG.7
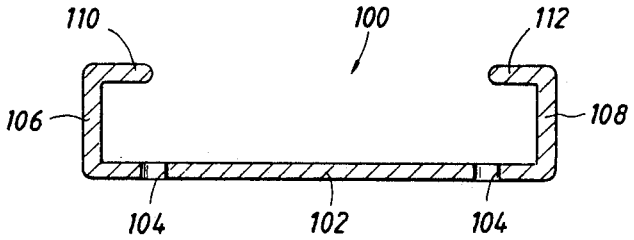
FIG.8
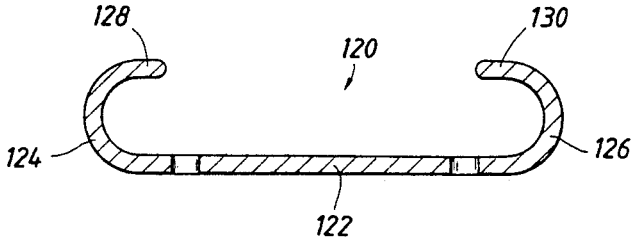
FIG.11
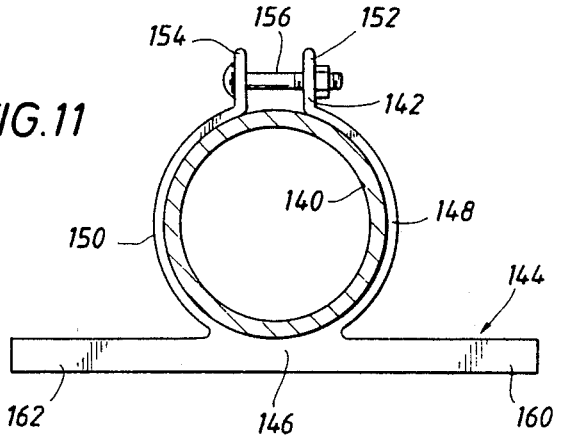
FIG.13
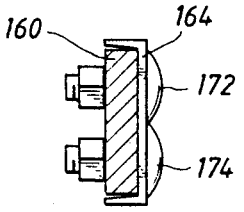
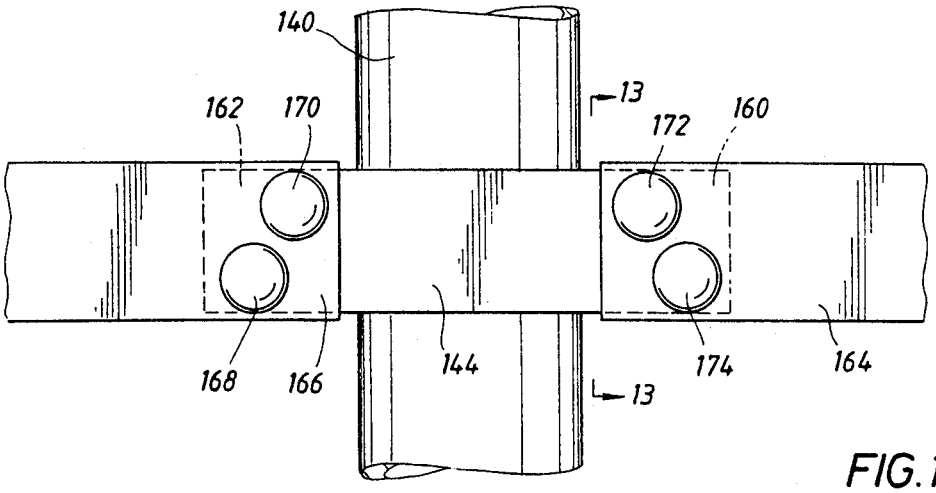
FIG.12

FENCE EMPLOYING FLAT SIDED GALVANIZED STEEL POSTS AND CHANNEL PARTS

This application is a continuation-in-part of application Ser. No. 07/559,623, filed Jul. 30, 1990, now abandoned.

BACKGROUND OF THE INVENTION

1. Field of the Invention

This invention pertains to a fence construction and particularly to a fence comprising parts that are readily prefabricated so that they can be put together by a "do it yourself" fence builder, but resulting in a fence that is durable and aesthetically attractive.

2. Description of the Prior Art

Many fences that are seen in residential neighborhoods are picket board fences that, except for nails, gate hinges and locks, and possibly underground foundations for the support posts, are all wooden in construction with only the individual pickets and the posts being pre-cut. Although the wood used can vary, cedar is a common material often employed for its long-lasting qualities and relative imperviousness to the ravages of the environment, including termites and the like. Nevertheless, even cedar fences quickly turn gray and the posts deteriorate, especially at the ground line where the posts enter the ground and/or their respective concrete footings In time, the boards give way at their nail holes and the fences lean, come apart and are generally unsatisfactory as fences. Fences of this type have been known to decay to an unsatisfactory state in only 10 or a few more years, requiring substantial repairs or in many cases, replacement with new materials.

Longer lasting fences employ metal posts, rather than wooden posts. Although fences having enclosed box channel posts are known, most commonly, the metal posts that are used more than any other are metal tubing posts. It is possible to completely drill a bolt hole through such a metal post; however, the most common connection is to use holding bands or straps that go around the post to be secured at its ends by screws or bolts to the cross piece or railing. It will be evident that such securement allows the post to rotate relative to the railing and for the bands and the attached cross piece to slide up or down or even to pull one way or the other and tear the holes of the band. In short, banding the posts to the railings in accordance with prior procedures has not been very satisfactory.

Bolting to a tubular post is extremely tricky and employs extremely long bolts to go through both sides of the tubular post. Even bolting to an enclosed box channel can be tricky and employs long bolts. In addition, an enclosed box channel often accumulates debris and even trash through its top open end that attracts bugs and, with trash decay, can create unpleasant odors. The wooden pickets on metal posts still deteriorate at about the same rate as with an all-wooden fence, requiring painting or replacement, as before. Metal tubular posts, unless they are very heavy gauge, also will not stand up to hard usage and have been known to bend or sever if the fence is subjected to a large lateral force.

Therefore, it is a feature of the present invention to provide an improved frame structure for a fence that is made of standard sized parts that can be pre-fitted for accurate assembly even by a novice fence builder, yet provide a more durable and attractive fence than is commonly on the market.

It is another feature of the present invention to provide an improved versatile fence structure that can be employed to mount wooden pickets, sheet metal panels, plastic panels, metal rods, and other fence coverings.

SUMMARY OF THE INVENTION

The fence structure of the preferred embodiment employs sturdy, vertical galvanized iron posts that are strengthened by having one or more vertical bends and providing at least one flat side to accommodate the attachment of transverse cross rails. The flat side of the in-line post is either wide enough or separated into two smaller width segments so that the adjoining ends of two rail sections can each be secured to the post, preferably through pre-drilled bolt holes. The railing sections can touch in some of the embodiments; however, there is no requirement that they do so.

The rails are preferably U-channel in shape and the sides of the channels on the ends are cut back or undercut so that these rail ends can be positioned flush against the flat side of the post to which they are secured. The bolt holes are preferably countersunk or drilled all the way through with internal flat sides to accommodate and grippingly secure the flats of bolt heads placed therein.

The posts are preferably secured in a concrete base. The majority of fence frames will have a top and bottom railing; however, a middle railing can be employed as well for tall fences or to make an extremely sturdy fence.

The posts can be variously shaped so long as only a single thickness of metal is required to secure a railing to a post.

An alternate framing structure for attaching to rails of the general type just described involves using a different kind of post. Such a post is really a combination of a tubular support and a clamping means, the clamping means including a compressible ring for clamping around the post and a rail hanger integrally attached tangentially along one side of the ring. The hanger includes two wings extending in opposite directions, one wing attachable to a rail section on one side of the support and the other wing attachable to the other rail section that is aligned end-to-end with the first at the support. The railing sections will not actually touch endto-end in this embodiment. The wings are flat-sided and preferably are sized to conveniently slip into the adjacent channel end of the accommodating rail section. Matching bolt holes are included in the wings and the rail ends for permitting bolts to be used for securing the rail hanger to the respective rails. Separate clamping means are used on the support for the top rail, for the bottom rail and for each intermediate rail of the framing structure.

The fencing material is preferably made up of metal panels, typically panels made of aluminum or sheet steel. However, plastic panels, wooden or plastic pickets or slats, or metal rods or bars can be employed.

BRIEF DESCRIPTION OF THE DRAWINGS

So that the manner in which the above recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

IN THE DRAWINGS

FIG. 1 is a front view of a fence in accordance with a preferred embodiment of the invention, the fence covering being only partly shown and the base of the posts being shown in cross section.

FIG. 2 is a cross-sectional view of the fence shown in FIG. 1 taken at view 2—2.

FIG. 3 is a cross-sectional view of the fence shown in FIG. 1 taken at view 3—3.

Figure 4:
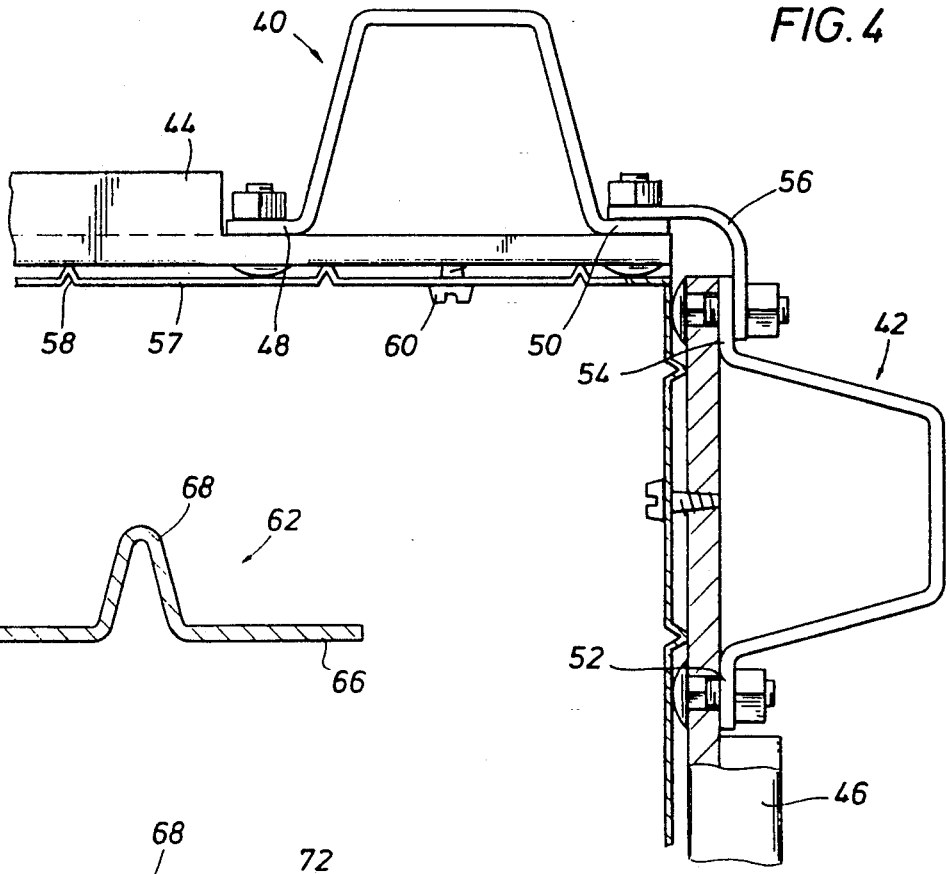

FIG. 4 is a cross-sectional view of the fence shown in FIG. 1 taken at view 4—4.

Figure 5:
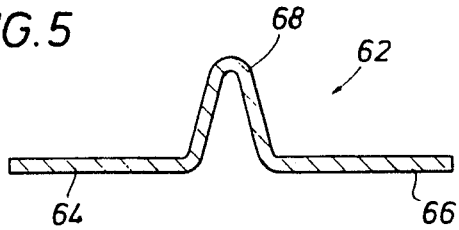

FIG. 5 is a cross-sectional view of an alternate in-line post in accordance with the present invention.

Figure 6:
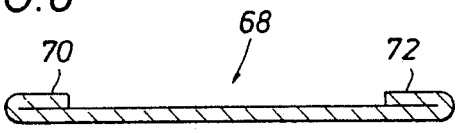

FIG. 6 is a cross-sectional view of yet another alternate in-line post in accordance with the present invention.

FIG. 7 is a cross-sectional view of still another alternate in-line post in accordance with the present invention.

FIG. 8 is a cross-sectional view of yet another alternate in-line post in accordance with the present invention.

Figure 9:
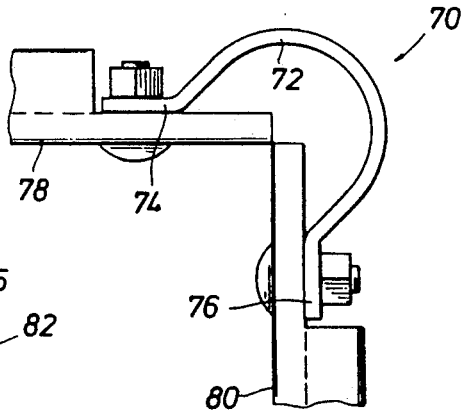

FIG. 9 is a cross-sectional view of an alternate corner post in accordance with the present invention.

Figure 10:
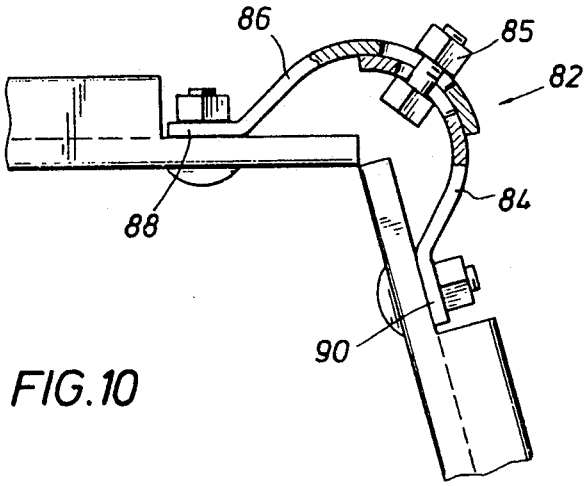

FIG. 10 is a cross-sectional view of yet another alternative corner post in accordance with the present invention.

FIG. 11 is a top view of a clamping means secured to a tubular support in accordance with yet another alternate post structure in accordance with the present invention.

FIG. 12 is a front view of the clamping means shown in FIG. 11 and further showing attachment thereof to adjacent rail sections;

FIG. 13 is an end view of a rail section as it is attached to the clamping means shown in FIGS. 11 and 12, FIG. 13 showing the view taken at line 13—13 shown in FIG. 12.

DESCRIPTION OF THE PREFERRED EMBODIMENTS

Now referring to the drawings, and first to FIG. 1, a fence segment is shown under construction in accordance with the present invention. A vertical, galvanized iron, in-line post 10 is shown in the center of the drawing, the bottom end of which is anchored in concrete block 12. The block is normally poured in place while the post is supported in place and may be flush with the ground or slightly below the ground surface.

The horizontal or transverse cross-sectional view of the in-line post is shown in FIG. 2, which reveals that post 10 is generally U shaped. This type of post is sometimes referred to as a galvanized delineator post. A post that is 3/16-inch thick is satisfactory for fence purposes. The other dimensions of a preferred embodiment of the FIG. 2 post are as follows: length of back 14 of the U is 1 ¼ inches, length of legs 16 and 18 attached to back 14 are also each 1 ¼ inches long, length of feet 20 and 22 attached respectively to legs 16 and 18 are each ½-inch long, and the overall length of the cross-section from foot end to foot end is 3 ⅛ inches. It will be seen that there are four stiffening or strengthening vertical bends in the post, two between the legs and the back and two between the feet and the legs. As a result, even a very large lateral force caused by wind or an impact against the fence would not cause the post to bend in contrast with what would occur to a flat post without having at least one such bend. Also, the post is open sided and will not collect debris like a closed structure would. It will be recognized that such a post is employed occasionally for holding "no parking" and similar road signs, but it is not known heretofore that any such post has been used in the manner described for a fence frame application.

The mounting of the post with the railing sections is provided by the flat sides of feet 20 and 22, which are parallel to and located adjacent transverse railing sections 24 and 26 secured to the post. Moreover, mounting employs only one thickness of metal of the post, in contrast to a tubular post or a box-channel post directly bolted to railing sections using long bolts that would have to pass through a wall, an intervening space, and another wall before it passes through the railing metal.

Feet 20 and 22 are respectively pre-drilled to freely accept the threaded ends of bolts 28 and 30, respectively. Behind the heads of bolts 28 and 30 are hexagonal shaped bolt parts 32 and 34, respectively. These hexagonal parts are grippingly held in place by pre-drilled and countersunk holes in rail section 24 and 26, respectively. The countersinking can be partly through the thickness of the metal or all the way through. These holes have internal flat holding sides that accommodate the hexagonal parts of bolts 28 and 30 and keep them from turning as nuts 36 and 38, respectively, are screwed or tightened onto bolts 28 and 30. A 5/16-inch bolt size is preferred. Also, bolts that are differently configured and sized from the type shown and described can be used, if desired. For instance, plain bolts can be used without countersunk bolt holes. Also, the holes in feet 20 and 22 can be internally grooved to hold the bolts without the need of nuts 36 and 38, if desired.

The railings are generally U shaped. The U-channel dimensions of the railings, which is preferably also conveniently 3/16-inch gauge material, has a typical center portion that is 2 ½ inches wide and side pieces that are ⅝-inch high. These dimensions and other dimensions referred to herein and other dimensions of approximately these values are acceptable. The railings, like the posts, are preferably made of galvanized material.

It should also be noted that the ends of channel railing section 24 and 26 are not generally U shaped as just described and as shown in FIG. 3. Such ends adjoin at post 10 and have to conform to post 10. Thus, they are cut away or undercut on their sides so as to permit the long center part of these railing sections to snugly positioned flush with the surfaces of post legs 20 and 22, respectively. The railing sections themselves do not have to touch each other.

Generally, two bolts are employed to hold each railing section end to a post. Thus, as shown in FIG. 3, bolt 28 previously described, and a similar bolt 29, are shown as securing rail section 24 to post 10.

FIG. 4 illustrates how the basic parts that have been previously described are employed to make a fence corner. Two posts 40 and 42, similar in structure to post 10, are employed having their flat sided mounting feet respectively parallel to the two sides of a fence. In this case, the two sides are at right angles, but it is obvious that the two sides can meet at an acute or obtuse angle instead. Also, post 40 is secured to the end of railing section 44 and post 42 is secured to the end of railing section 46. The end of railing section 44 is cut away on its sides a greater distance than described for a post 10 connection to allow the flat center portion of the end of the railing section to be attached to both feet 48 and 50 of post 40 by bolt and nut combinations, as previously described. The end of the railing extends even with foot 50 so as to form an appropriate corner with the end of railing section 46. In similar fashion, the end of railing section 46 is cut away on its sides the same distance as the cut away portions of the end of railing section 44 to allow the flat center portion of the end of the railing section to be attached to both feet 52 and 54 of post 42 by bolt and nut combinations, as previously described. It will be seen that the tips of railing section ends 44 and 46 do not touch to permit the heads of the bolts respectively inserted in adjacent foot 50 of post 40 and foot 54 of post 42 to be inserted without interference.

Two or three angle braces 56 can be employed, if desired, to secure together posts 40 and 42. Each brace is about two inches long and has a center bend appropriate for the angle of meeting for the two fence planes, in this case, a 90° center bend. Each side of the angle brace has at least one hole for accommodating a bolt in the same manner as described for posts 40 and 42. In a preferred embodiment, angle brace 56 has two vertically aligned holes on each side for permitting attachment to foot 50 of post 40 and foot 54 of post 42, respectively. The brace is preferably 3/16" thick, but braces of other thicknesses can be used, if desired. Since it is preferred that the same bolts be used to secure angle brace 56 to foot 50 as are used to secure foot 50 to railing end 44, the holes in all three parts are preferably aligned and the bolts are sufficiently long to effect such securement.

Angle brace 56 is similarly secured to foot 54 of post 42. The location of the angle brace at the top will be determined by the location of the top railing section, which is normally about 4 to 5 inches from the top of the fence. Similarly, the location of the angle brace at the bottom will be determined by the location of the bottom railing section, which is normally about 4 to 5 inches from the bottom of the fence. A middle angle brace can be secured to posts 40 and 42 in like fashion to provide stronger bracing, if desired, and may be employed independently of whether or not there is a middle railing or there are multiple intermediate railings between the top and bottom railings.

The fence covering, which can be any one of numerous structures and material, is popularly a complete or non-see-through covering. One such covering is a metal or plastic sheeting 57 having periodic vertical crimps 58 for structural strength and beauty reasons. Such crimps 58, and between sheeting panels, similar vertical seams, will cause the sheeting to be separated a slight distance from the railings, and, thus, between the crimps, in contact with the heads of the securement bolts. Metal, preferably galvanized, screws 60 are then employed to hold the fence covering to the railings, as needed. Similar washers can be used behind the screw heads, as desired. Pre-started holes or at least markings can be employed for locating such screws, if desired. Alternatively to what is shown, the sheeting can be such that the crimps are to the outside rather than the inside, as shown.

Furthermore, if desired, the covering may include a galvanized mesh, the mesh being fine enough to allow an evergreen vine or other suitable live plant to climb and fill out the mesh. Such mesh can be used in lieu of any other covering and, thus, will provide privacy when the plant has grown and filled in to an adequate amount. The mesh can also be used with another covering so that privacy is immediately obtained, but the plant will enhance the beauty of one or both sides, depending on the location of the mesh and how the plant is encouraged to grow.

The most aesthetically desirable side of the fence just described will be on the inside opposite where the frame superstructure of posts and railings appears. Therefore, it is preferable that the posts be located outside the fence, as shown. In some cases, it may be desirable to have the fence covering on the outside of the fence. In such event, the corner posts would be located inside and spaced apart a sufficient distance to permit access to the holes in the posts for the bolts.

The fence frame that has been described can accommodate a fencing material of virtually any description. However, an attractive and weather-resistant panel that would most likely be employed would be a metallic panel, typically galvanized steel or aluminum, of the type that is commonly employed for awnings. Such panels are typically corrugated in that they are crimped or bent in a repeated pattern for strength purposes and can be painted or left unpainted, as desired.

Plastic panels can also be employed rather than metal panels and have the additional advantage of being made to look wood-like or brick-like or of other decorative design.

Of course, wood pickets or slats can be employed as well. With the sturdy metal frame just described, such a fence would still be longer lasting since wooden posts and railings are not used. Repair would be more convenient and less frequent than with an all wood fence.

Finally, such a metal fence frame as described would also accommodate metal rods or bars that are popular in security fences where see-through convenience is desired.

Although one suitable post has been described above, other post configurations are suitable. The important features that alternative post structures should have include at least one suitable flat side for attaching to the railing sections without having to employ bolts that go through a long open space, such as with a tubular post or a box-channel post. Also, a suitable post should strengthened by having one or more vertical bends.

Four alternate in-line posts are shown in FIGS. 5, 6, 7 and 8. In FIG. 5, alternate post 62 includes two flat feet 64 and 66 located on either side of a V-shape center connecting piece that provides the stiffening characteristic for the post, as previously described. It will be seen that such a post configuration can be joined to railings in the same manner as described for the post shown in FIG. 2.

Similarly, post 68 provides one long flat side and has folded over ends 70 and 72 that provide the reinforcing bends for the overall structure. Although the drawing only shows a single foldover end, the ends can each have an additional fold, if desired. The bolt receiving holes for attaching the railings would preferably be through the double thicknesses of the material at either end.

In similar fashion, FIG. 7 shows a post 100 that is quite stout having a straight-sided base 102 to accommodate attachment to rail sections in the manner previously described using bolt holes 104. End pieces 106 and 108, respectively, are joined contiguously at the opposite ends of base 102 to form therewith a generally U-shaped configuration. Finally, tip pieces 110 and 112 are joined respectively in contiguous fashion with end pieces 106 and 108. It is evident that base 102 has a flat side that is parallel to the railing sections to be joined thereto, end pieces 106 and 108 are at right angles to base 102, and tip pieces 110 and 112 are at right angles to the end pieces and thus are parallel to base 102. Although the base, end pieces, and tip pieces have been discussed as separate parts, in actuality the "parts" are preferably of single construction, forming a continuous contour.

FIG. 8 shows another post 120 that is very similar to post 100, except its base 122 is joined to its respective end pieces 124 and 126 in a smooth curve and end pieces 124 and 126 are joined respectively to tip pieces 128 and 130 in a smooth curve. Thus, the overall construction configuration is a continuous curvilinear contour.

Although only four alternative post structures are shown, additional posts having multiple V-bends like bend 68 in FIG. 5 could be employed, if desired. Such bends could be in a center location or away from the center. Even additional post structures having one or more bends or stiffening or strengthening contours could be used, if desired.

Posts 62, 68, 100, and 120 would preferably be made of the same 3/16" material as for post 10, although other thicknesses and other materials could be used, as desired.

Alternate corner posts are shown in FIGS. 9 and 10. Corner post 70 shown in FIG. 9 has a graceful partial arcuate center portion 72 secured to foot 74 on one side and foot 76 on the other. In FIG. 9, these feet present flat mounting side for railings 78 and 80 that meet at a right angle. The arcuate center portion provides the strength of a bend, as with the other posts, and provides a central opening to permit the railings to abut. The feet of the post provide for bolt holes to allow securement by bolts, as with the other structures. Because only a single post is needed, rather than two, there is no need for bracing.

FIG. 10 shows an adjustable corner post 82 somewhat similar in structure to post 70. In this case, the post is in two parts such that each has a foot 88 and 90, respectively, and a partial arcuate center section 86 and 84, respectively. The respective center sections overlap each other. Aligned, circumferential elongate slots are provided to receive a bolt 85 through both sections 84 and 86 and to permit foot 88 to be adjustably aligned at a right angle with foot 90, or at a desired acute or obtuse angle, depending on the meeting planes of the fence at the corner. Thus, a single universal corner post can be employed to accommodate the flexible needs of the fence builder.

It should also be mentioned, that brick columns can also be used in place of posts, if desired, or the brick side of a building or archway structure can be employed in place of a single post. In such case, hangers to receive the railings can be set into the concrete between the bricks as they are set in place or can be secured to an already existing brick structure using suitable technique and hardware known to those skilled in the art of attaching gates and other similar structures to brick.

Now referring to FIGS. 11, 12, and 13, a post construction is shown employing a popular vertical tubular support 140. A tubular support is desirable because it does include a natural strengthening bend and is readily available. As previously mentioned, prior art methods of attaching such a support to a fence have all had shortcomings. By contrast, as shown in FIG. 11, clamping means structure is employed therewith that overcomes such shortcomings and includes clamp portion 142 contiguously integral with rail hanger 144, such as by welding at weld 146, or as a result of being included therewith in a single casting.

Clamp 142 includes opposing arcuate segments 148 and 150 that together define the majority of a circle so as to embrace support 140. Attached at the ends of arcuate segments 148 and 150 are clamp ends 152 and 154, respectively, in a fashion commonly employed with clamps of this general type. Suitable bolt holes are located in ends 152 and 154 and a tightening bolt-and-nut combination 156 is employed in conjunction with these holes to compressibly tighten and thereby squeeze the clamp around tubular support 140.

Rail hanger 144 is comprised preferably of a single bar or plate that forms wings 160 and 162 tangentially integral with arcuate segments 148 and 150 at the location where they merge, thereby forming a solid piece therewith. Wings 160 and 162 project in opposite directions in a common plane providing flat-sided surfaces for attaching to rail sections in much the same fashion as for the previously described post structures.

Referring now to FIG. 12, wings 160 and 162 of rail hanger 144 are shown respectively attached to adjacent ends of railing sections 164 and 166, respectively. The ends of these railing sections do not have to be undercut in the manner described above for other railing sections since the vertical dimension of the rail hanger bar or plate making up wings 160 and 162 is sized to fit into or be accommodated within the channel end of railing sections 164 and 166, as shown in FIGS. 12 and 13. Bolts 168 and 170 are employed to attach Wing 162 to railing section 166 using appropriate matching bolt holes in the two pieces being joined in the manner discussed for previous embodiments. In this case, the bolts are staggered, rather than being in vertical line, but other alignments and less or more bolts can be employed, if desired. In similar fashion, bolts 172 and 174 attach wing 160 to railing section 164.

Thus, it will be seen that even though support 140 has a rounded surface, by being combined with a tubing-clamp-and-rail-hanger combination, the same advantages of the other fence posts are provided. That is the vertical support is firmly held (by the clamp portion that will not slip or rotate with respect to the tubular support) and flat-sided surfaces are provided (by the rail hanger portion) integral with the clamp portion that fits conveniently into the adjacent channel ends of the railing sections to lay flatly next to a flat surface of the railing sections for securement by short bolt-and-nut or equivalent bolting means. It should be seen that the railing sections are aligned end-to-end; however, in this embodiment of the invention they do not actually touch.

It may be seen that the construction of the fence frame that has been described in the various configurations employs posts, railing sections and bolt-and-nuts that can be standardized for virtual foolproof assembly even by an inexperienced fence builder. Thus, the structure is particularly suited for the "do-it-yourself" builder. However, because the frame can accept a fencing material of almost any description, it is useful as the basis for being covered with aluminum sheet panels, plastic panels, wood pickets, plastic pickets, metal rods or many other coverings. Many of such coverings are available that would not support a fire and, therefore, unlike the common cedar fence, are much safer from a fire prevention point of view.

While several embodiments of the invention have been shown and other variations described, it will be understood that the invention is not limited thereto. Many modifications may be made and will become apparent to those skilled in the art. For example, although two railings are shown and described, one or more additional railings can be employed, if desired.

What is claimed is:

1. A fence, comprising:

a plurality of vertical galvanized iron posts having a transverse cross section with at least one elongated strengthening bend and having at least one flat side to accommodate the attachment of rails;

at least a bottom and a top rail transverse to said posts, each rail comprising multiple sections placed end to end, said sections consecutively being adjacent each other and overlapping at least a portion of the flat side of one of said posts;

a fence covering attachable to said rails;

said rail sections and said posts having pre-drilled holes so that two adjacent rail sections are attachable at one of said posts by bolts received through said holes;

said rail sections having a flat side adjacent said fence covering and at least opposite flat-sided ends adjacent corresponding accommodating flat sides of said posts;

a corner post having a transverse cross section with at least one elongated strengthening bend and at least a first flat side to accommodate the attachment of a first rail section end for each said top and bottom rail in a first plane and at least a second flat side to accommodate the attachment of an adjacent second rail section end for each said top and bottom rail in a second plane, said first flat side and said second flat side of said corner post being joined by a partially round intermediate segment comprising:

a first arcuate segment attached to said first flat side, a second arcuate segment attached to said second flat side, said first arcuate segment and said second arcuate segment each having at least one elongate slot therein covering a circumferential portion of its segment such that when said first and second arcuate segments overlap they are securable to make an entire corner post with a bolt received through said respective slots at an adjustable angle for said first plane and said second plane; and said first and second flat sides of said corner post having pre-drilled holes so that said first and second rail section ends are attachable respectively at said first flat side and said second side of said corner post by bolts received through said pre-drilled holes of said rail section ends.

2. A fence in accordance with claim 1, wherein said adjustable angle includes a range of acute to obtuse angles.

* * * * *